United States Patent [19]

Okita et al.

[11] Patent Number: 5,022,354

[45] Date of Patent: Jun. 11, 1991

[54] COOLING SYSTEM FOR V-TYPE ENGINE

[75] Inventors: Junichi Okita, Iwakuni; Toshikazu Kurokawa, Hiroshima, both of Japan

[73] Assignee: Mazda Motor Corporation, Hiroshima, Japan

[21] Appl. No.: 580,375

[22] Filed: Sep. 11, 1990

[30] Foreign Application Priority Data

Sep. 23, 1989 [JP] Japan ..... 1-110953[U]
Sep. 23, 1989 [JP] Japan ..... 1-110954[U]

[51] Int. Cl.[5] ..... F01P 7/14
[52] U.S. Cl. ..... 123/41.1; 123/195 C
[58] Field of Search ..... 123/41.08, 41.09, 41.1, 123/41.44, 41.46, 41.47, 195 C, 198 E

[56] References Cited

U.S. PATENT DOCUMENTS 2,852,009 9/1958 Turlay ..... 123/41.47
4,212,270 7/1980 Nakanishi et al. ..... 123/41.1
4,565,163 1/1986 Ishimi et al. ..... 123/41.44

FOREIGN PATENT DOCUMENTS 59-128915 7/1984 Japan ..... 123/41.1

*Primary Examiner*—Noah P. Kamen
*Attorney, Agent, or Firm*—Fleit, Jacobson, Cohn, Price, Holman & Stern

[57] ABSTRACT

A cooling system for a V-type engine includes a radiator, having inlet and outlet conduits extending between the radiator and the engine, which cools coolant introduced therein through the inlet conduit, and a water pump with an inlet port, disposed between the engine body and the radiator, which circulates the coolant, leaving the radiator through the outlet conduit, through the engine body. Between the radiator and water pump, the cooling system is provided with a bypass passage, which communicates a passage, connecting both of the outlet ports to the inlet conduit, with a downstream part of the outlet conduit where a thermostat is installed, and a suction passage which communicates the inlet port of the water pump with the downstream part of the outlet conduit by a suction passage. The suction passage comprises an external passage, constituting an upstream portion thereof, which is disposed in the V-shaped space, and an internal passage, constituting a downstream portion thereof, which is formed in the engine body below the V-shaped space.

10 Claims, 3 Drawing Sheets

COOLING SYSTEM FOR V-TYPE ENGINE

FIELD OF THE INVENTION

The present invention relates to a cooling system for a V-type, water-cooled, internal combustion engine, and, more particularly, to an engine cooling system having a novel cooling structure.

BACKGROUND OF THE INVENTION

Various kinds of cooling systems for V-type, water-cooled, internal combustion engines have been developed in the past. Such a cooling system typically includes a water pump for circulating coolant, such as cooling water, through the engine. In general, the water pump is located in front of a lower center portion of a front end surface of the engine body. Cooled water flows from a radiator into an inlet port of the water pump, passing through a radiator outlet pipe and a suction pipe located at the front of one of right and left cylinder banks of the engine body. The water pump pressurizes the cooling water and forces the pressurized cooling water to flow around cylinders of the right and left cylinder banks through a connecting passage located in front of the right and left cylinder banks. The cooling water then passes up through cylinder heads of the right and left cylinder banks on its way out of the engine. The water, after leaving the engine body, returns into the radiator through an engine outlet passage and a radiator inlet pipe and has its temperature, which was increased by the heated engine, reduced by the radiator. The cooling system typically has a thermostat for providing constant temperature control. The thermostat is typically installed in front of the engine body, at a juncture between the radiator outlet pipe and a bypass connecting the radiator outlet pipe and the radiator inlet pipe. As is apparent from the above, it is usual in laying out the cooling system to locate both the thermostat and the suction pipe in what is termed a "dead space" left in one of the right and left cylinder banks between the front end of the engine body and the foremost cylinder. Such dead space is formed because one of the right and left cylinder banks is offset in the forward direction, with respect to the vehicle, relative to the other cylinder bank. Such an arrangement of a cooling system is known from, for instance, Japanese Utility Model Application No. 59 - 41150, entitled "Cooling System For V-Type Engine," filed on Mar. 22, 1984, and laid open as Japanese Unexamined Utility Model Publication No. 60 - 153818 on Oct. 14, 1985.

The cooling system as described in the above publication necessarily has a suction pipe, a bypass, a connecting passage and radiator inlet and outlet pipes, all of which must be great in length. This results in a bulky and messy cooling system and a complicated structure of the engine body around the pipes. Furthermore, since long pipes generate a great increase in friction drag on the cooling water, a water pump having a large size and water delivery volume must be installed.

Because the thermostat is located below the radiator inlet pipe, the cooling water, which is quite hot when leaving the engine body, is not expected to flow up the bypass by free convection. For this reason, since the water pump has only a low delivery capacity when the engine operates at a low speed and, accordingly, the circulation speed of the cooling water is low, it is difficult to keep the cooling water in the engine body at a constant temperature.

In addition to the above, because a front cover is attached to the engine so as to cover and protect a timing belt for coupling pulleys of valve driving camshafts and an engine crankshaft, heat, generated by the engine itself or due to friction between the timing belt and the pulleys, is retained in a space between the engine front cover and the front end of the engine. The heat lowers the service life of the timing belt. The complicated arrangement of various pipes makes it considerably troublesome to remove air in the cooling system.

SUMMARY OF THE INVENTION

It is, therefore, a primary object of the present invention to provide a cooling system for a V-type water-cooled internal combustion engine in which various passages are simply arranged and a dead space of an engine body is efficiently used to contain an arrangement of elements of the cooling system.

It is another object of the present invention to provide a cooling system for a V-type, water-cooled, internal combustion engine in which a water pump having a small delivery capacity can be installed.

It is still another object of the present invention to provide a cooling system for a V-type, water-cooled, internal combustion engine which can cool a space, formed between an engine front cover and one end of the engine body, wherein the elements of the engine developing heat are arranged.

The objects of the present invention are accomplished by providing a cooling system for a V-type, water cooled, internal combustion engine with an engine body which has elongated first and second cylinder banks, each having an inlet port and an outlet port formed in a front end thereof, set at an angle to each other to define a V-shaped space therebetween. The cooling system includes a radiator, having inlet and outlet conduits extending between the radiator and the engine body, for cooling a coolant, such as cooling water, introduced therein through the inlet conduit. The cooling system further includes a water pump with an inlet port, disposed between the engine body and the radiator, for circulating the coolant, which leaves the radiator through the outlet conduit, through the engine body.

Between the radiator and the water pump, the cooling system is provided with a bypass passage, which communicates a passage, connecting both of the outlet ports to the inlet conduit, with a downstream part of the outlet conduit where a thermostat is installed, and a suction passage which communicates the inlet port of the water pump with the downstream part of the outlet conduit by a suction passage. The suction passage comprises an external passage, constituting an upstream portion thereof, which is disposed in the V-shaped space, and an internal passage, constituting a downstream portion thereof, which is formed in the engine body below the V-shaped space. The bypass passage is preferably integrally formed in a front engine cover for covering and protecting at least a timing belt, located in front of the engine body, by which a crankshaft and an overhead camshaft are coupled to each other, so as to transmit engine output from the crankshaft to the overhead camshaft.

BRIEF DESCRIPTION OF THE DRAWINGS

The above and other objects and features of the present invention will be apparent from the following description of a preferred embodiment thereof when considered in conjunction with the appended drawings, in which.

DESCRIPTION OF THE PREFERRED EMBODIMENT

Figure 1:
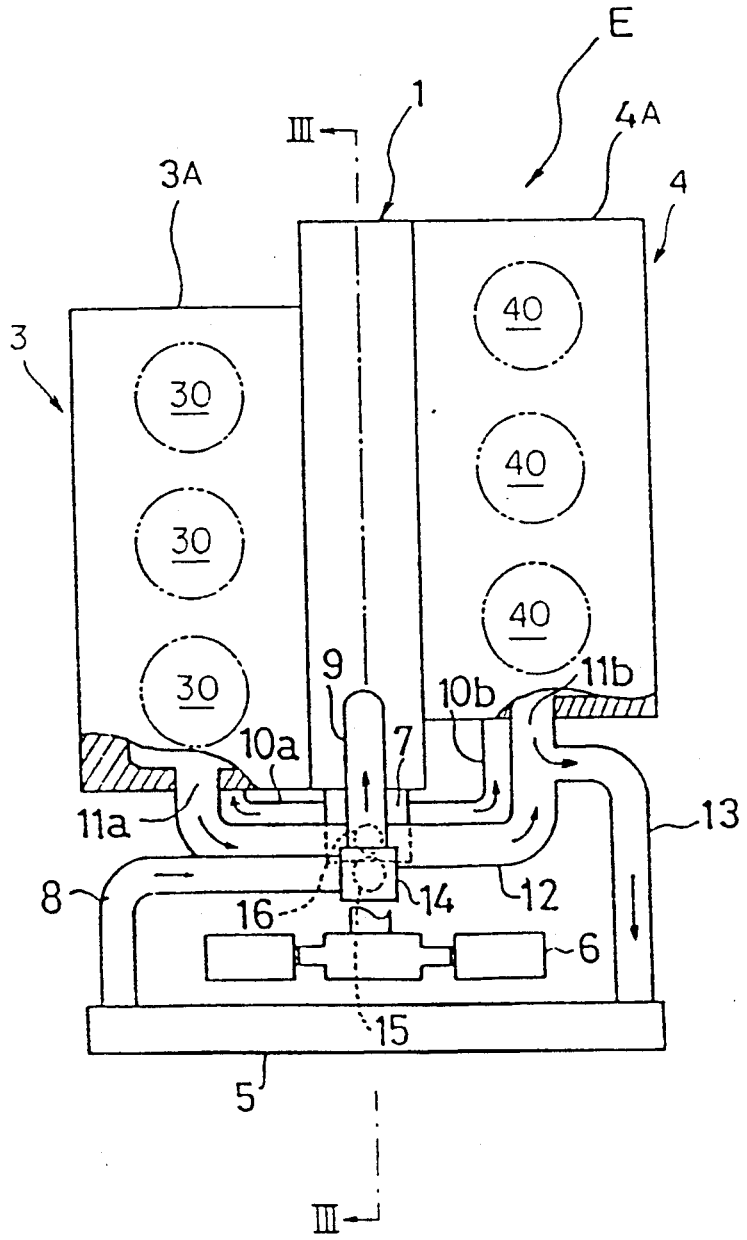
FIG. 1 is a diagrammatic plan view of a V-6, water cooled, internal combustion engine with a cooling system according to a preferred embodiment of the present invention.
Figure 2:
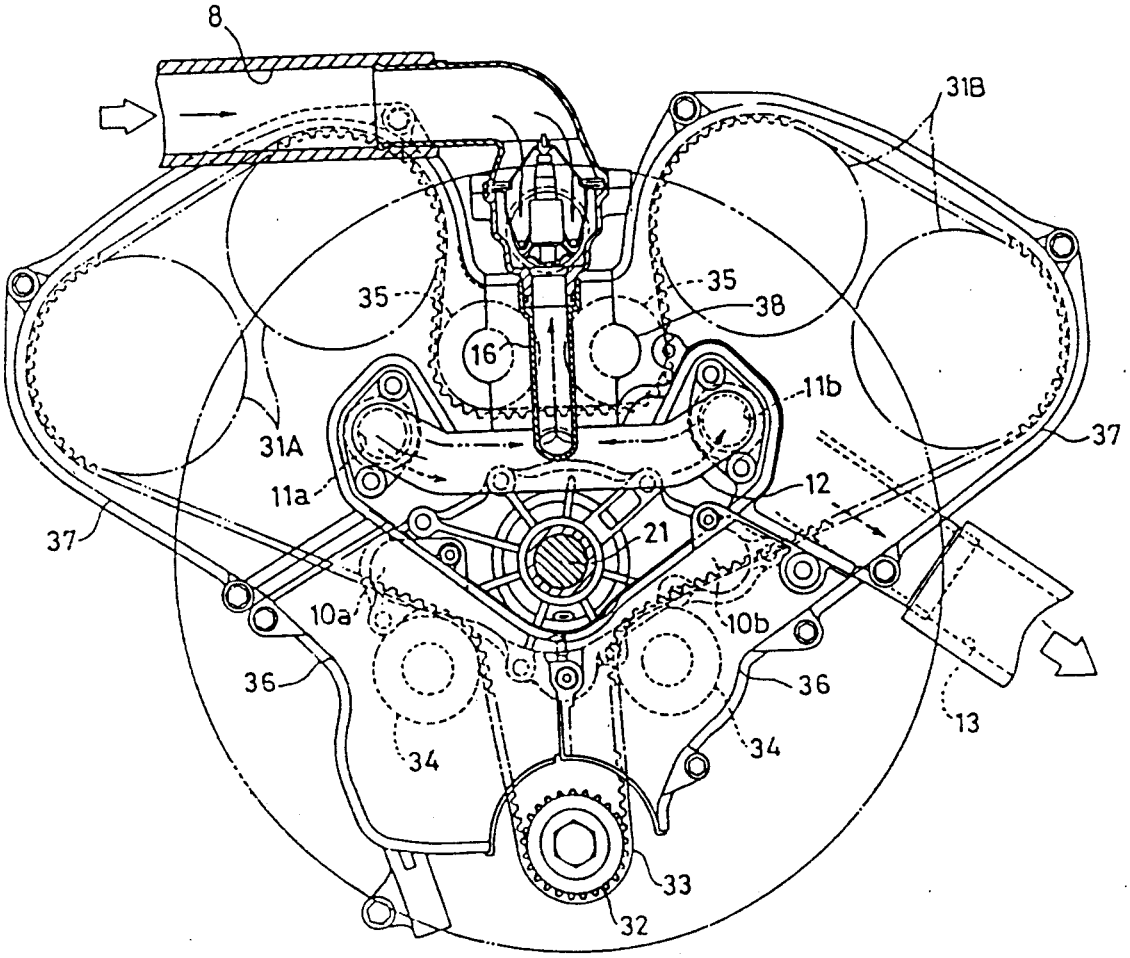
FIG. 2 is a front end view of the V-6, water cooled, internal combustion engine shown in FIG. 1.
Figure 3:
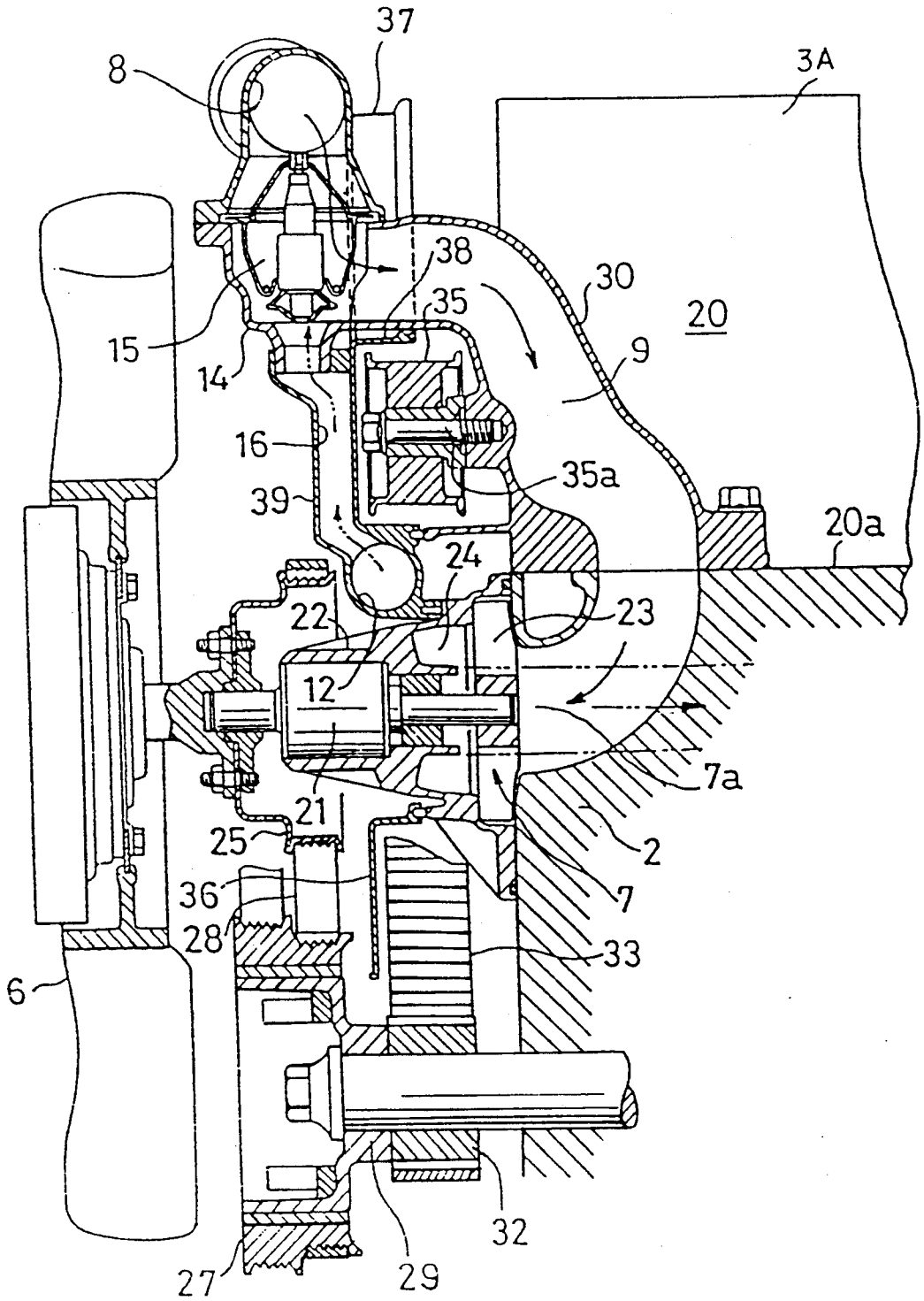
FIG. 3 is a cross-sectional view of FIG. 2 as seen along section line III—III.

Referring to FIGS. 1 to 3 in detail, a V-type engine, for instance a V-6 water cooled internal combustion engine, having a cooling system in accordance with a preferred embodiment of the present invention, is shown. The engine body 1 consists of elongated left and right cylinder banks 3 and 4, arranged in a V-formation with a predetermined relative angle therebetween. For example, a relative angle of 60 degrees between the cylinder banks 3 and 4 may be provided so as to define a V-shaped space 20 therebetween. What are termed the No. 1, No. 3 and No. 5 cylinders 30 are formed and arranged in a straight row in the left cylinder bank 3, and what are termed the No. 2, No. 4 and No. 6 cylinders 40 are formed and arranged in a straight row in the right cylinder bank 4. The No. 1 cylinder, the No. 6 cylinder, the No. 3 cylinder, the No. 4 cylinder, the No. 5 cylinder and, finally, the No. 2 cylinder are fired, in order. That is, the cylinders 30 and 40 are divided into two groups, and the cylinders 30 or 40 in each group are disposed in one and the same cylinder bank 3 or 4, respectively, so that adjoining cylinders in each cylinder bank 3 or 4 do not fire sequentially, i.e., one after another. The left and right cylinder banks 3 and 4 are offset with respect to the vehicle in which they are mounted and relative to each other, so that the row of the cylinders 30 in the left cylinder bank 3 is offset forward, with respect the vehicle, relative to the row of the cylinders 40 in the right cylinder bank 4.

The engine body 1 has a cylinder block 2 (see FIG. 3) provided with cylinder bores in which pistons (not shown) can slide and pair of cylinder heads 3A and 4A which are mounted on the cylinder block 2, and provide for the left and right cylinder banks 3 and 4, respectively. A crankshaft 29 is supported by the cylinder block 2 for rotation. In a well known manner, the crankshaft 29 is connected to each piston by a connecting rod. Each connecting rod is of well known type.

The crankshaft 29 partly projects from the cylinder block 2. A crankshaft sprocket or pulley 32 is coaxially fixed on the part of the crankshaft 29 projecting from the cylinder block 2. The crankshaft pulley 32 is connected, or coupled, to pulleys 31A and 31B, fixed to overhead camshafts, by a timing belt 33 to drive the camshaft pulleys 31A and 31B so that they open and close intake and exhaust ports of the engine at a predetermined timing by intake and exhaust valves, respectively. The timing belt 33 is tensioned by lower and upper pairs of idle pulleys 34 and 35. The lower pair of idle pulleys 34 are located, side by side, between the crankshaft pulley 32 and the camshaft pulleys 31A and 31B disposed outside the left and right banks 3 and 4 remote from the V-shaped space, respectively. The upper pair of idle pulleys 35, each being mounted for rotation on a passage block 30 by a shaft 30*a*, are located, side by side, between the camshaft pulleys 31A and 31B adjacent to each other. The crankshaft and camshaft pulleys 32 and 31A and 31B, and the timing belt 33, together constitute an overhead camshaft driving mechanism.

A water pump 7 is disposed in front of a vertical center line of the front end surface of the cylinder block 2 just below the bottom 20*a* of the V-shaped space 20. The water pump 7 has a pump housing 22 attached to the front end surface of the cylinder block 2 so as to form a pump chamber or discharge chamber 24 therebetween. A rotary shaft 21, having an axis of rotation passing through a center of the cylinder block 2, is coaxially mounted on a boss of the pump housing 22 for rotation. The rotary shaft 21 is coaxially fixed, at its inner end, to an impeller 23 of the water pump 7 located within the discharge chamber 24 and, at its outer end, to a pump pulley 25 to which a fan 6 is firmly bolted. A drive belt 28 connects or couples the pump pulley 25 to a pulley unit 27, fixed to the end of the crankshaft 29, so as to transmit the engine output to the pump pulley 25 to drive the water pump 7 and the fan 6.

The front engine cover, for covering the belt 33 and the crankshaft and camshaft pulleys 32 and 31A and 31B, comprises five pieces of cover segments made of aluminum alloy, namely, a pair of generally pentagonal lower cover segments 36, arranged side by side, a pair of generally trapezoidal upper cover segments 37, arranged side by side, and a generally trapezoidal center cover segment 38 located between the lower and upper cover segments 36 and 37. In particular, the lower cover segments 36 cover the idle pulleys 34 and part of the front end surface of the cylinder block 2 surrounding the idle pulleys 34; the upper cover segments 37 cover the camshaft pulleys 31A and 31B and part of the front end surface of the cylinder block 2 surrounding the camshaft pulleys 31A and 31B. The center cover segment 38 has, as an integral part, a passage block 39, formed with a communication passage 12 and a bottom bypass passage 16 therein. This center cover segment is preferably made by aluminum casting.

Coolant, such as cooling water, leaves a bottom tank of a down-flow radiator 5 through a lower radiator hose or outlet conduit 8 and is introduced into a pump inlet port 7*a* of the water pump 7 through a suction passage 9. The cooling water is pressurized and forced, by the water pump 7, to flow into water jackets (not shown) formed in the left and right cylinder banks 3 and 4 through bank inlet ports 10*a* and 10*b* formed in front ends of the left and right cylinder banks 3 and 4, respectively, and pass up through the cylinders on its way out. The cooling water, on leaving the engine body 1, is discharged through bank outlet ports 11*a* and 11*b*, formed in the front ends of the left and right cylinder banks 3 and 4, respectively, and a communication passage 12 communicating the bank outlet ports 11*a* and 11*b* with each other. The cooling water further flows back into a top tank of the down-flow radiator 5 through an upper radiator hose or inlet conduit 13. The bank outlet ports 11*a* and 11*b* of the left and right cylinder banks 3 and 4 are located slightly above the bank inlet ports 10*a* and 10*b* in the front ends of the left and right banks 3 and 4. The communication passage 12 is located horizontally in front of the front end surface of the engine body 1 above the water pump 7 and is communicated with the upper radiator hose 13 near the front end surface of the right cylinder bank 4. The lower radiator hose 8 is provided with a thermostat 15 installed in a thermostat chamber 14, having a substantially cylindrical shape, at a downstream part thereof. In a manner which is well known in the art, the thermostat 15 shuts off the flow of the cooling water from the down-flow radiator 5 to the engine body 1 when the cooling water is cold, for instance, before the engine has been warmed up, so that the engine body 1 is heated quickly. When the cooling water reaches a predetermined temperature, the thermostat 15 opens and allows free circulation of the cooling water. Therefore, the cooling water flowing through the bottom bypass passage 16 is always cold.

The communication passage 12 is connected to a juncture between the lower radiator hose 8 and the suction passage 9 by the bottom bypass passage 16, branching off from the middle portion of the communication passage 12.

The downstream portion of the lower radiator hose 8 extends from an upper front end surface of the left cylinder bank 3 to an upper front end of the V-shaped space 20. The substantially cylindrical chamber 14 of the lower radiator hose 8, in which the thermostat 15 is installed, is vertically positioned in front of a vertical center line of a spatial front end of the V-shaped space 20. The bypass passage 16 is connected to the bottom of the middle portion of the communication passage 12, where the cylindrical thermostat chamber 14 is formed, so as to be coaxially aligned with a vertical center line of the thermostat 15.

The suction passage 9, extending from the cylindrical chamber 14 of the lower radiator hose 8 to the pump inlet port 7*a*, comprises an external passage, constituting an upstream portion thereof, having approximately two thirds of the whole length of the suction passage 9, formed in the passage block 30, which is partly disposed in the front part of the V-shaped space 20, and an internal passage portion, constituting a downstream portion thereof, which is formed in a front part of the cylinder block 2 as a quarter-circular internal passage, i.e., one which bends through approximately 90 degrees.

In operation of the cooling system for a V-type internal combustion engine, in accordance with the specific embodiment of the present invention, when the engine body 1 is cold, such as before it has been warmed up, the thermostat 15 shuts off the flow of the cooling water in the lower radiator hose 8 from the down-flow radiator 5 to the engine body 1. Accordingly, the cooling water, pressurized by and discharged from the water pump 7, circulates through the left and right bank inlet ports 10*a* and 10*b*, the water jackets of the left and right cylinder banks 3 and 4, the left and right bank outlet ports 11*a* and 11*b*, the communication passage 12, the bottom bypass passage 16 and the suction passage 9, in that order. Since a water pump used in a cooling system typically has a decrease in delivery capacity while the engine is idling, before it has been warmed up, the cooling water usually flows in the water jacket of the engine at a low rate and, accordingly, the temperature of cooling water in the water jacket of the engine is apt to be non-uniform. However, in the cooling system of this invention, since the bottom bypass passage 16 extends vertically from the communicating passage 12 between the left and right bank outlet ports 11*a* and 11*b*, the cooling water supply is enhanced, due to the flow of cooling water up in the bottom bypass passage 16, by free convection. This causes a high circulation speed of the cooling water, resulting in a more uniform temperature of the cooling water in the water jackets of the engine body 1, so as to uniformly cool the engine body 1.

Because the center cover segment 38 is integrally constructed with the passage block 39, formed with the communication passage 12 and the bottom bypass passage 16, the cooling water flowing in the bottom bypass passage 16 absorbs heat inside the cover segments 36, 37 and 38 so as to cool the front engine cover and elements arranged inside the front engine cover.

After the engine body 1 has sufficiently been warmed up, the thermostat 15 opens the lower radiator hose 8, so as to allow a large part of the cooling water, which has pressurized by the water pump 7 and reached the left and right bank outlet ports 11*a* and 11*b* through the left and right bank inlet ports 10*a* and 10*b* and the water jackets of the left and right cylinder banks 3 and 4, to flow into the top tank of the down-flow radiator 5 passing through the communication passage 12 and the upper radiator hose 13, in that order. As the cooling water flows down from the top tank to the bottom tank, it gives off heat to the down-flow radiator 5 and, thereby, is cooled. At the same time, the cooling water leaving the left and right bank outlet ports 11*a* and 11*b* partly flows to the suction passage 19 from the communication passage 12 through the bottom bypass passage 16.

In the cooling system arranged as described above, the layout of the cylindrical thermostat chamber 14 located in front of the vertical center line of the front end of the engine body 1 above the communication passage 12 allows the suction passage 9 to comprise the external upstream and internal downstream portions, to form the external upstream portion of the suction passage 9 in the passage block 30 partly disposed in the front part of the V-shaped space 20, and to form the internal downstream portion of the suction passage 9 in the front part of the cylinder block 2 as a quarter-circular passage. Therefore, the V-space 20, which is conventionally left unused as a dead space, is effectively made use of for arranging the suction passage 9. Furthermore, the suction passage 9 may be made short in length and simple in structure.

Because the left and right bank outlet ports 11*a* and 11*b* are located in the front end surface of the engine body 1, the communication passage 12 required to communicate the bank outlet ports 11*a* and 11*b* with each other is sufficiently short in length so as to contribute to efficiently making use of the small space left in front of the engine body 1.

Because the bottom bypass passage 16 substantially vertically extends in a straight line between the communication passage 12 and the thermostat chamber 14 of the lower radiator hose 8, it may be made short in length and simple in structure, so as to contribute to making the engine compact.

Furthermore, because the cooling water always flows through the communication passage 12 and the bottom bypass passage 16, both of which are formed in the passage block 39, the center cover segment 38, formed integrally with the passage block 39, is cooled and, therefore, a space between the front cover and the engine body 1 is also cooled, so as to contribute to prolonging the service life of the timing belt 33.

The shortened passages, such as the suction passage 9, the communication passage 12 and the bottom bypass passage 16, make it possible to construct the cooling system so that it is very compact and light. The shortened passages also introduce the cooling water into the water pump 7 with a reduced water flow resistance, so as to permit an increased flow rate of the cooling water. This allows utilization of water pumps with small delivery capacities.

It is to be understood that although the invention has been described in detail with respect to a specific embodiment thereof, nevertheless, various other embodiments and variants are possible which are within the spirit and scope of the invention, and such other embodiments and variants are intended to be covered by the following claims.

What is claimed is:

1. A cooling system for a V-type, internal combustion engine, comprising:

an engine body having elongated first and second cylinder banks set at an angle relative to each other to define a V-shaped space therebetween, each said cylinder bank having an inlet port and an outlet port formed in a front end thereof;

a radiator, having inlet and outlet conduits extending between said radiator and said engine body, for cooling coolant introduced therein through said inlet conduit;

a water pump, having an inlet port, disposed in front of said engine body for circulating said coolant, leaving said radiator through said outlet conduit, through said engine body;

a communication passage disposed in front of said front ends of said first and second cylinder banks so as to communicate each outlet port with said inlet conduit;

a thermostat installed in downstream part of said outlet conduit and located above said communication passage in front of said engine body;

a bypass passage communicating said communication passage with said outlet conduit at said downstream part; and a suction passage extending so as to communicate said downstream part and said inlet port with each other, said suction passage comprising an external passage, constituting an upstream portion thereof, disposed in said V-shaped space, and an internal passage, constituting a downstream portion thereof, formed in said engine body below said V-shaped space.

2. A cooling system as defined in claim 1, wherein said bypass passage extends straight up from said communication passage to said outlet conduit.

3. A cooling system as defined in claim 1, wherein said outlet port is located above said inlet port of each said cylinder bank.

4. A cooling system as defined in claim 1, wherein said internal passage is formed as a quarter-circular passage.

5. A cooling system as defined in claim 1, wherein said bypass passage is integrally formed in a front engine cover for covering at least a timing belt for transmitting rotation of an engine crankshaft to overhead camshafts.

6. A cooling system as defined in claim 5, wherein said front engine cover is made of aluminum.

7. A cooling system as defined in claim 5, wherein said front engine cover is formed by aluminum casting.

8. A cooling system for a V-type, internal combustion engine having an engine body including elongated first and second cylinder banks, each said cylinder bank having at least an outlet port formed in a front end thereof and being provided with a crankshaft and an overhead camshaft coupled to said crankshaft by a timing belt located in front of said engine body so as to transmit rotation of said crankshaft to said overhead camshaft, said cooling system comprising:

a radiator, having inlet and outlet conduits extending between said radiator and said engine body, for cooling coolant introduced therein through said inlet conduit;

a water pump disposed in front of said engine body for circulating said coolant, leaving said radiator through said outlet conduit, through said engine body;

a thermostat disposed in front of said engine body;

a bypass passage communicating each said outlet port with said thermostat; and a front engine cover, in which said bypass passage is integrally formed, for covering at least said timing belt.

9. A cooling system as defined in claim 8, wherein said front engine cover is made of aluminum.

10. A cooling system as defined in claim 9, wherein said front engine cover is formed by aluminum casting.

* * * * *